US011037405B2

(12) United States Patent
Orr et al.

(10) Patent No.: US 11,037,405 B2
(45) Date of Patent: Jun. 15, 2021

(54) GROUP DYNAMIC WAGERING SYSTEM

(71) Applicant: SCORENT LLC, Foster City, CA (US)

(72) Inventors: Scott Orr, Foster City, CA (US); Keith Orr, Foster City, CA (US); Adam Bellin, Belmont, CA (US)

(73) Assignee: SCORENT LLC, Foster City, CA (US)

( * ) Notice: Subject to any disclaimer, the term of this patent is extended or adjusted under 35 U.S.C. 154(b) by 38 days.

(21) Appl. No.: 16/005,480

(22) Filed: Jun. 11, 2018

(65) Prior Publication Data

US 2018/0357862 A1 Dec. 13, 2018

Related U.S. Application Data

(60) Provisional application No. 62/517,787, filed on Jun. 9, 2017.

(51) Int. Cl.
*G07F 17/32* (2006.01)

(52) U.S. Cl.
CPC ..... *G07F 17/3267* (2013.01); *G07F 17/3223* (2013.01); *G07F 17/3276* (2013.01)

(58) Field of Classification Search
None
See application file for complete search history.

(56) References Cited

U.S. PATENT DOCUMENTS 6,863,606 B1 * 3/2005 Berg ..... G07F 17/32 463/16
2001/0038178 A1 * 11/2001 Vancura ..... A63F 9/183 273/274
2003/0040357 A1 * 2/2003 Baerlocher ..... G07F 17/3262 463/20
2017/0266542 A1 * 9/2017 Schwarck ..... G06Q 30/0203

* cited by examiner

*Primary Examiner* — Robert T Clarke, Jr.
(74) *Attorney, Agent, or Firm* — Dergosits & Noah LLP

(57) ABSTRACT

A system and methods for cross-platform wagering with group-dynamic results are described. The methods use wagering data collected in real-time from cross-platform mobile and browser applications. Payouts are based on group-dynamic inputs and results are updated on a continuous basis.

9 Claims, 11 Drawing Sheets

GROUP DYNAMIC WAGERING SYSTEM

CROSS-REFERENCE TO RELATED CASES

The present application claims priority to U.S. Provisional Patent Application No. 62/517,787, entitled "GROUP DYNAMIC WAGERING SYSTEM," filed on Jun. 9, 2017, which is hereby incorporated by reference.

TECHNICAL FIELD

The present disclosure relates generally to a system of wagering for an online game, and specifically, to wagering involving a group dynamic where the results of the wager are determined by the actions of other players.

BRIEF DESCRIPTION OF THE DRAWINGS

The embodiments are illustrated by way of example and not limitation in the figures of the accompanying drawings, in which like references indicate similar elements, and in which.

DETAILED DESCRIPTION

This disclosure contemplates embodiments of a wagering system that accounts for group dynamics. In the embodiments, the group dynamic of player actions as a whole will influence the outcome of individual wagers.

Wagering Assessment

In an embodiment, players may make a selection from among a set of choices. The selection is noted and associated with the player and stored by the server. To determine whether the player wins, all the stored answers are retrieved by the server and processed according to the method to determine the popularities of the potential choices. The player's choice is then compared to determine where it fits in a popularity-based ranking of the potential choices.

Figure 1:
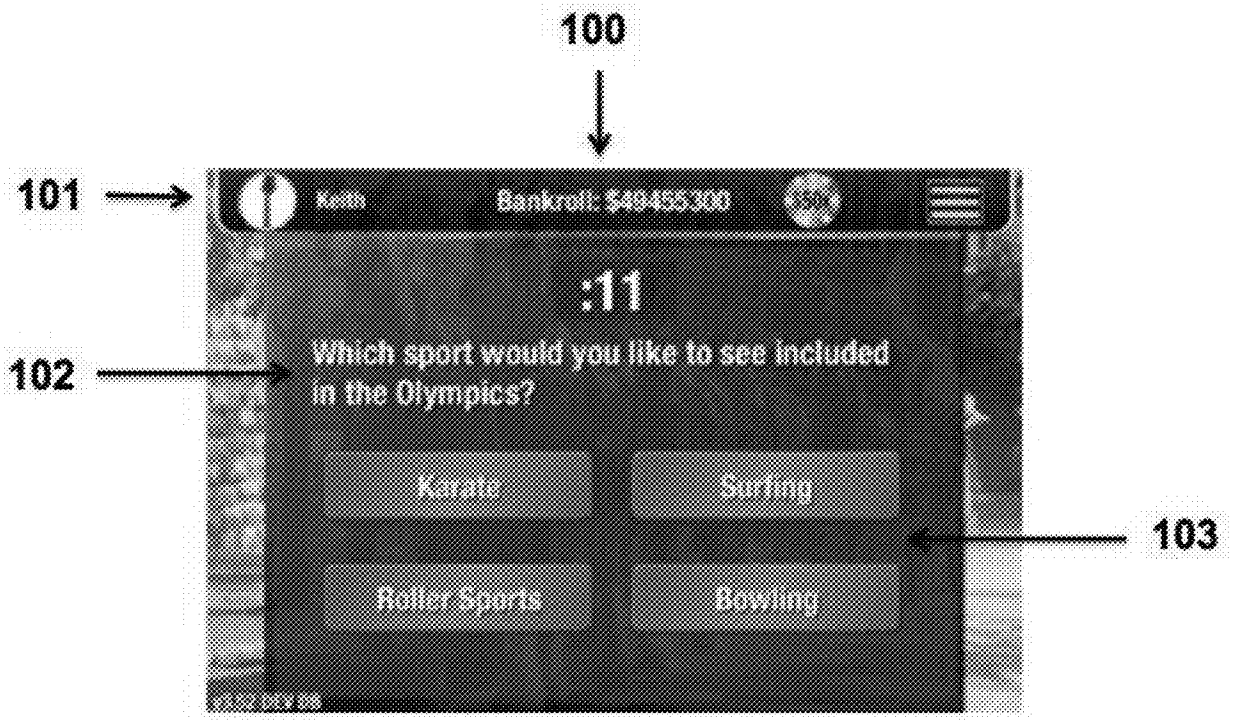
FIG. 1 depicts a screenshot of an embodiment of a graphical user interface depicting a step of a method for a group dynamic wagering system.

FIG. 1 depicts a screenshot of an embodiment of a graphical user interface 100 (or "selection interface") depicting a step of a method for a group dynamic wagering system. A player profile 101 indicates the player's name, available bankroll, and the player's status level at the top of the screen.

An opinion question 102 is shown with a certain time left (0:11) to make a choice. Four available opinion choices 103 are displayed.

Figure 2:
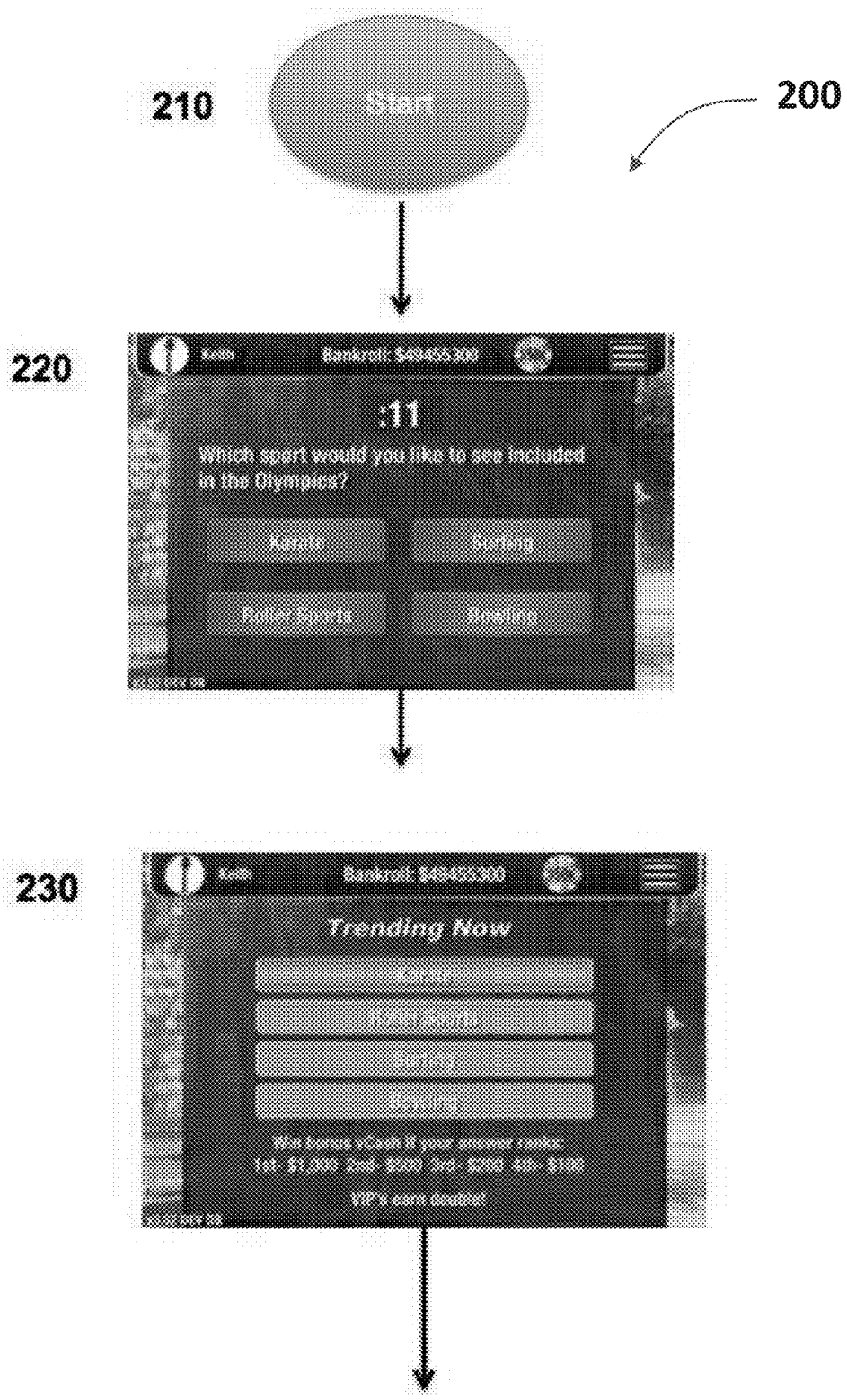
FIG. 2 depicts an embodiment of a method for a group dynamic wagering system.
Figure 2:
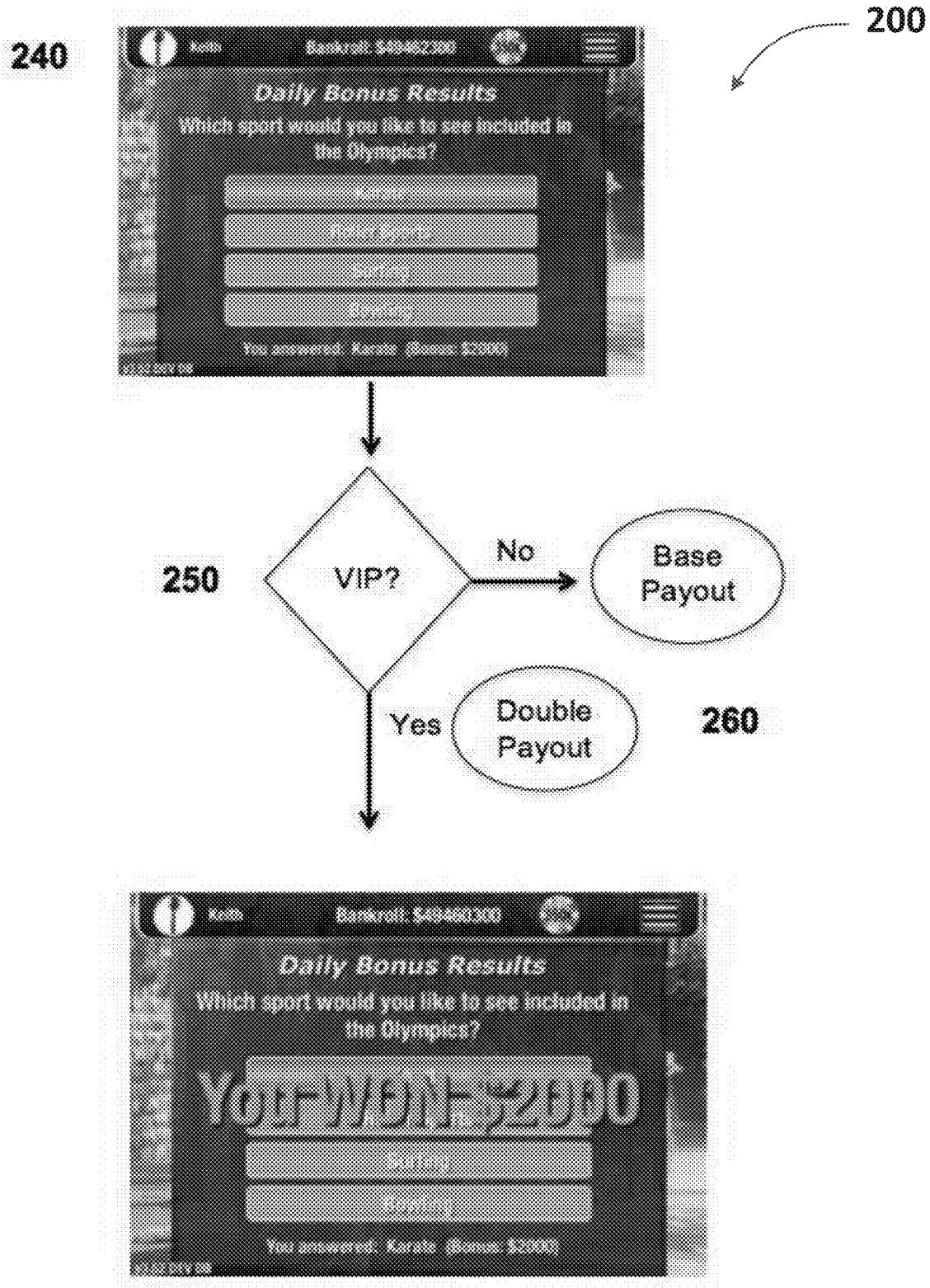

FIG. 2 depicts an embodiment of a method 200 for a group dynamic wagering system. In step 210, a player starts and is shown a list of choices. In step 220, the player selects their preference from among the choices. The player places an associated wager (not shown). In step 230, the method predicts and reveals how the choices are trending by calculating the total number of players who have responded up to that time with an answer divided by the total number of all answers for each question. The method also reveals the guaranteed payouts (e.g., $1000, $500, $200, and $100 for the top through fourth ranked answer). In step 240, a real-time check is performed on the servers after an arbitrary amount of time has passed (e.g., an hour, or a day) to determine the ranking of the choices and how the player's choice ranks among the most popular choices by other players per the method. The particular player's answer of "Karate" resulted in a Bonus of $2000 as a result of the player's choice of "Karate," which ranked first of choices 1-4 and which paid $1000, and the player having purchased VIP level according to step 250. In step 250, a check is performed on the server to award double the payout if the player has purchased a VIP level. In step 260, a payout check is performed and the server updates the player's bankroll. If the player doesn't participate then the payout is zero.

Figure 3:
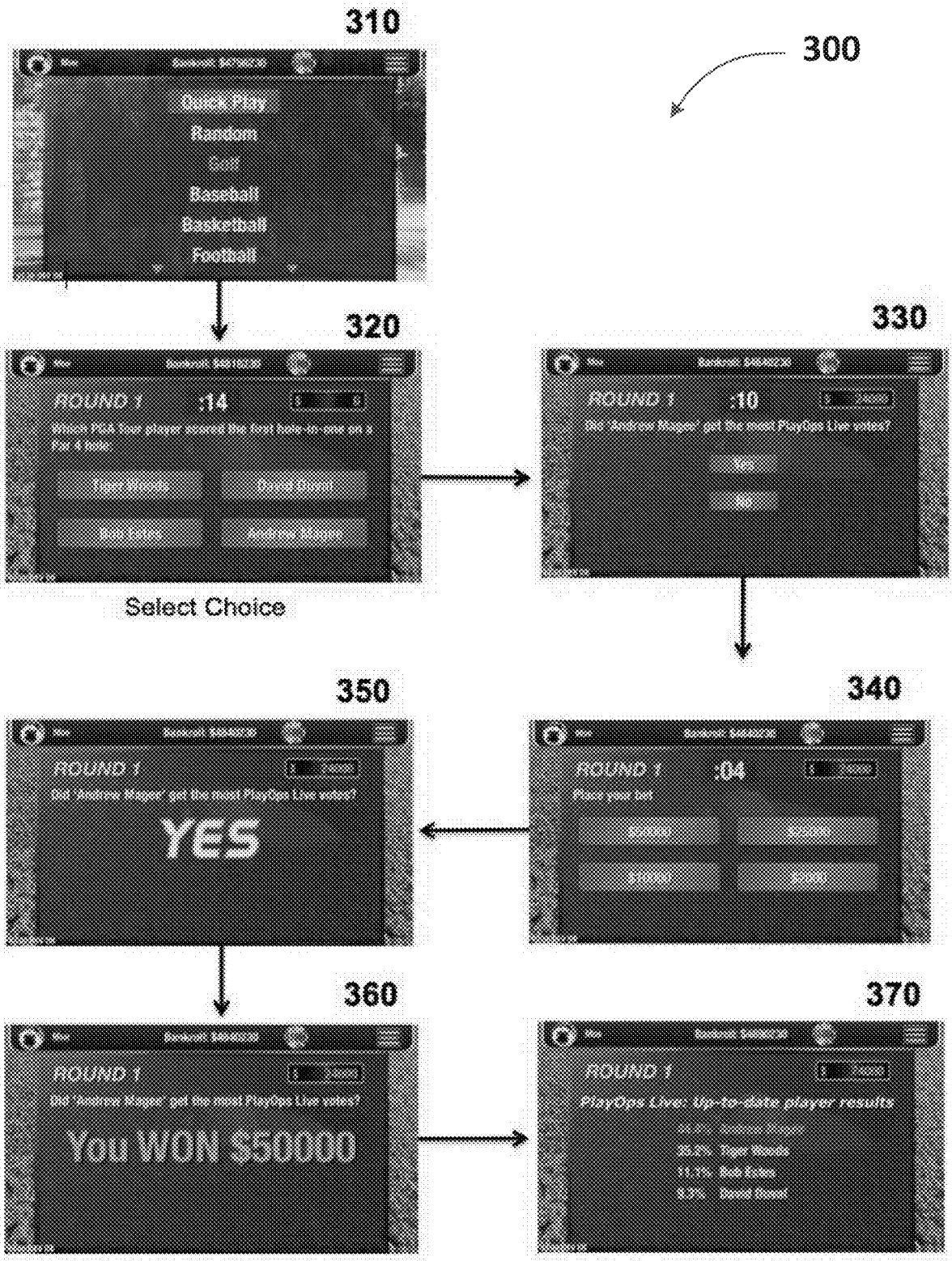
FIG. 3 depicts an embodiment of a method for a group dynamic wagering system.

FIG. 3 depicts an embodiment of a method 300 for a group dynamic wagering system. In the embodiment, there is one correct answer to a question, e.g., a trivia question, and bonuses are given by predicting the relative popularity of the responses selected from among a list of potential responses. In the embodiment, a graphical user interface is used that is similar to graphical user interface 100 ("selection interface"), but the question, e.g., a trivia question, has a correct answer—one of the choices presented. In the embodiment, in step 310, the player is shown a list of choices, e.g., categories of sports trivia, from which to select. After choosing one category, e.g., golf, in step 320 the player is provided with a list of potential answers to the question, and the player chooses one answer from the list within the time allotted. In step 330, the player selects whether the player thinks the correct answer is also the popular choice as determined by a real-time check of the total responses. In step 340, the player makes a wager 340 based on the players selection of whether the correct answer is also the popular choice. In step 350, a real-time check by the server is performed on the total number of responses received up to that time to determine if the correct answer is also the most popular choice made by the players. In other words, the real-time check is performed on the choices of players who have responded to the same question earlier than the current player, or at the same time as the current player. In step 360, the player's choice from step 330 is compared to the determination from step 350 and a payout or loss check is performed by the server and the player's bankroll is updated. In this example, because the player was correct that the popular choice was also the correct choice, a payout was made and $50,000 added to the player's bankroll. In step 370, the group dynamic results from the real-time check are displayed in descending order showing the popularity of the choices as determined using the method from step 230 (FIG. 2), described above. In an embodiment, an IQ bonus may be awarded for picking the correct answer for each question and the bonus may increase each subsequent round. In an embodiment, a speed bonus may be given for quicker answers related to the time remaining on the clock at one or more of the steps of the embodiment of FIG. 3.

In embodiments, the stakes may vary based on the player's VIP status level. In embodiments, wins may be awarded from an artificial bank in the game. And, in embodiment, payouts may be even, except when the embodiment involves rolling a standard 6-sided cube die that varies payouts from 1:1 to 6:1.

Figure 4:
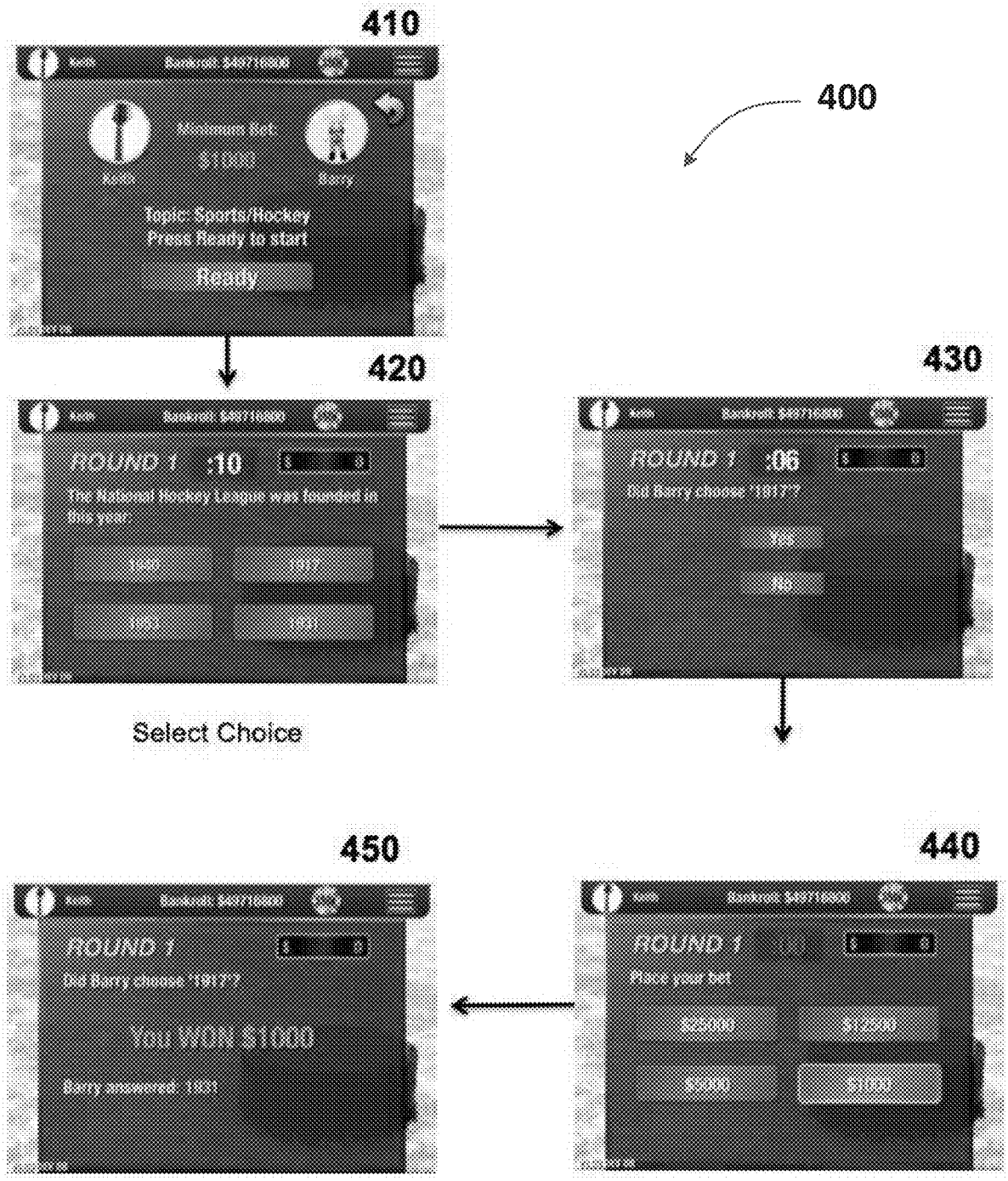
FIG. 4 depicts an embodiment of a method for a group dynamic wagering system.

FIG. 4 depicts an embodiment of a method 400 for a group dynamic wagering system. In an embodiment, there is one correct answer to a question, e.g., a trivia question, and bonuses may be awarded based on a player's prediction of how an opponent answered the question. In the embodiment, a graphical user interface is used that is similar to graphical user interface 100 ("selection interface"), but the question, e.g., a trivia question, has a correct answer—one of the choices presented. In step 410, the player (e.g., Keith) starts. The display reflects a selected topic (e.g., Sports/Hockey) and a selected opponent (e.g., Barry). In step 420, the player is shown a list of potential answers. In step 430, the player is shown the correct answer (e.g., 1917) and asked to select whether the correct answer was also their opponent's choice. In step 440, the player makes a wager based on their selection from step 430. In step 450, a real-time check is performed by the server to determine if the correct answer is also the opponent's choice. If the player's selection from step 430 matches the check from step 450, the player wins. If the selection from step 430 does not match the check from step 450, the player loses. The server updates the player's bankroll based on the win or loss in step 450. In an embodiment, in step 420, the player may also select what the player thinks is the correct answer. In an embodiment, an IQ bonus may be awarded for picking the correct answer in step 420 and the bonus may increase each subsequent round. In an embodiment, a speed bonus may be given for quicker answers related to the time remaining on the clock at one or more of the steps of the embodiment of FIG. 4. In an embodiment, stakes and bonus amounts are based on the player with the lower VIP level. In an embodiment, the real-time check may be made after both players have made their choices, or after a timer expires an arbitrary amount of time after step 440. For example, the opponent (Barry) may not yet have made any selection and the real-time check may be made when the allotted time expires and before Barry makes a selection, preventing Barry from participating in Keith's wager. The player's (Keith's) selections in steps 430 and 440 would not be affected by Barry's not participating, e.g., should the selection also apply to a different wager.

Figure 5:
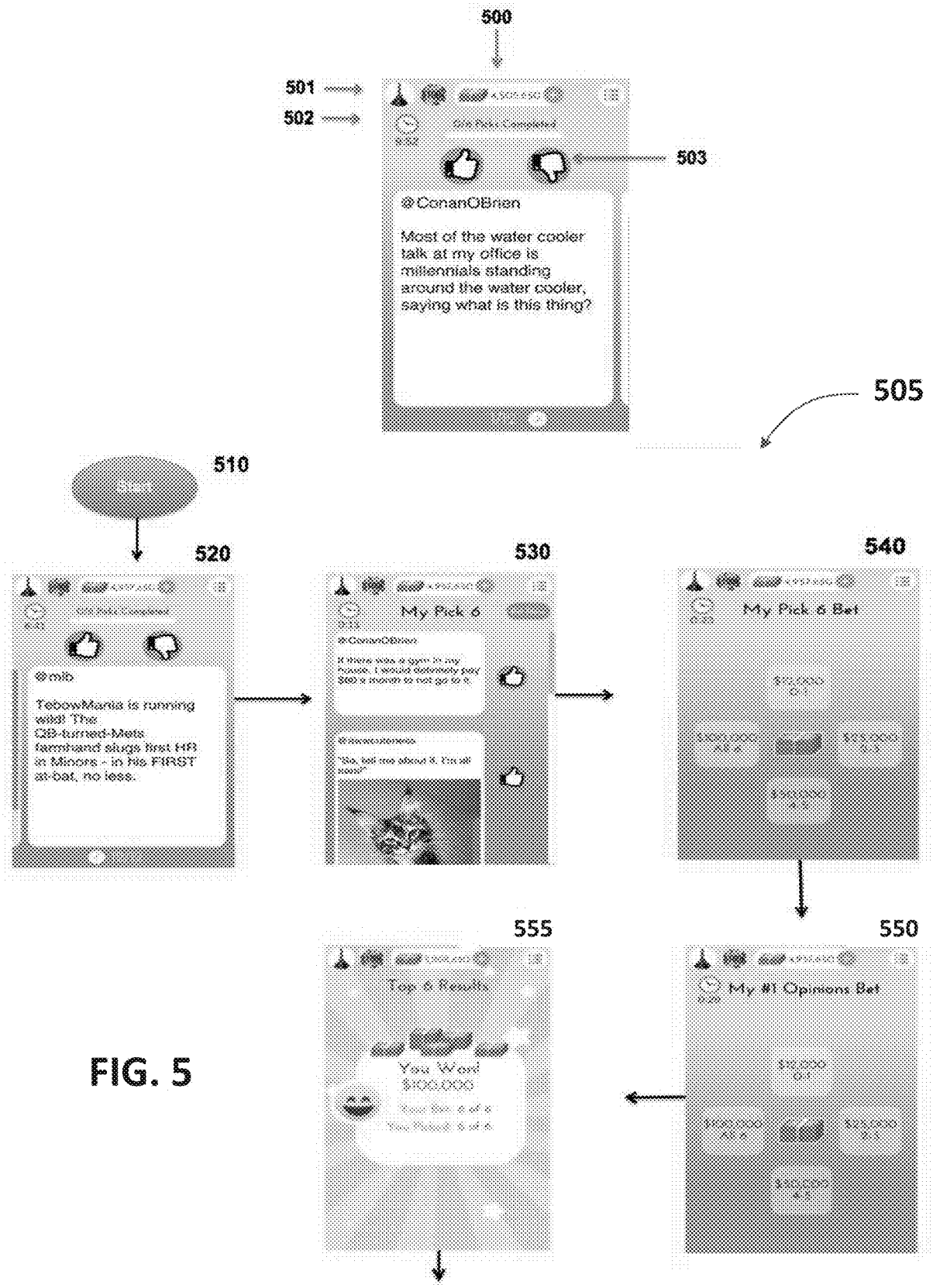
FIG. 5 depicts embodiments of a graphical user interface and a method for a group dynamic wagering system.
Figure 5:
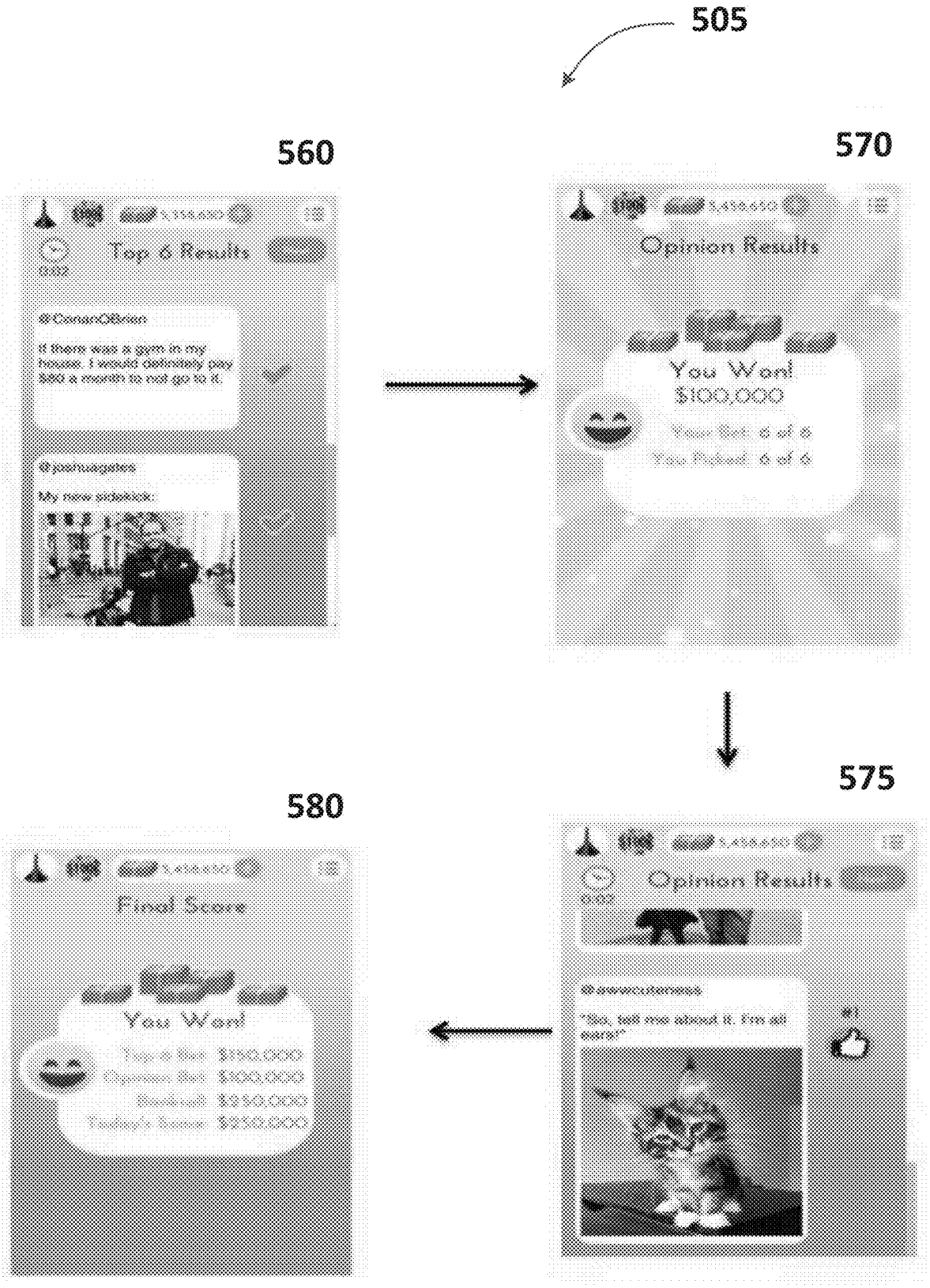

FIG. 5 depicts embodiments of a graphical user interface 500 and a method 505 for a group dynamic wagering system. In the embodiment, players select a limited number of their preferred options from a larger pool, and a player's results are based on the popularity of their choices compared to the choices of the total number of players. In the embodiment, a graphical user interface (or "selection interface") 500 displays a first line 501 with a player's profile, including the player's bankroll and status level, at the top of the display. In a second line 502, the user interface displays the time left and number of picks completed, indicating the player's progress toward selecting their preferred options. In a third line 503, the player is presented with an option to indicate a positive or negative preference for the displayed material, or the player may move on to the next option to review (e.g., by swiping left or right).

In method 505 for a group dynamic wagering system, in step 510 the player begins and is presented with a first option to review. In step 520, the player either casts their opinion one at a time by tapping either thumbs up or thumbs down on an option, or moves on to another option, with 6:41 left of an initial 10 minutes allotted for completing the selections. By swiping their device's screen left or right to view all of the daily choices the player continues picking their choices until an arbitrary number of selections has been made (six, in this example). In step 530, a summary of the player's selections is shown before wagering, with 0:11 remaining of an initial 15 seconds allotted for completing this task. In step 540, the player makes a wager (wagered dollar amount not shown) of how many of their picks (six, in this example) will make it into the top results (e.g., 0-1, 2-3, 4-5, or All 6), with 0:23 remaining of an initial thirty seconds allotted for completing this task. The payoffs for each wager are shown. In step 550, the player may make a wager of how many of their opinions (0-1, 2-3, 4-5, or All 6) will be in the majority (where the majority of participating players votes either thumbs up or thumbs down on that option). In step 560, a real-time check is made on the servers after an arbitrary amount of time has passed (e.g., an hour, or a day) to determine a ranking of choices based on their popularity among the collective group of participating players. The single player's opinions are also compared to the ranking of choices to determine the number of the player's opinions that made the top results (in the example, a check-mark is placed next to each player opinion that made the top results). In step 570, the number of the player's opinions in the top results is compared to the player's wager from step 550, with the player winning when the number of the player's opinions that made the top results equals the player's wager. In step 555, it is determined whether the player's wager from step 540 was a winning wager. In step 570, it is determined whether the player's wager from step 550 was a winning wager. In step 575, the player is shown how their selections in step 550 compared with respect to the majority. In step 580, the server provides a Final Score with the results of this round as determined in steps 570 and 555, and also updates the player's bankroll.

In embodiments, a real-time check may be performed immediately, or may be delayed an arbitrary amount of time following a step. Thus, a real-time check regarding a first player's selection(s) may allow for additional players to participate and their selections included in calculating results—even where those additional players' selections were made after the first player's selections.

Server Assessment

Figure 6:
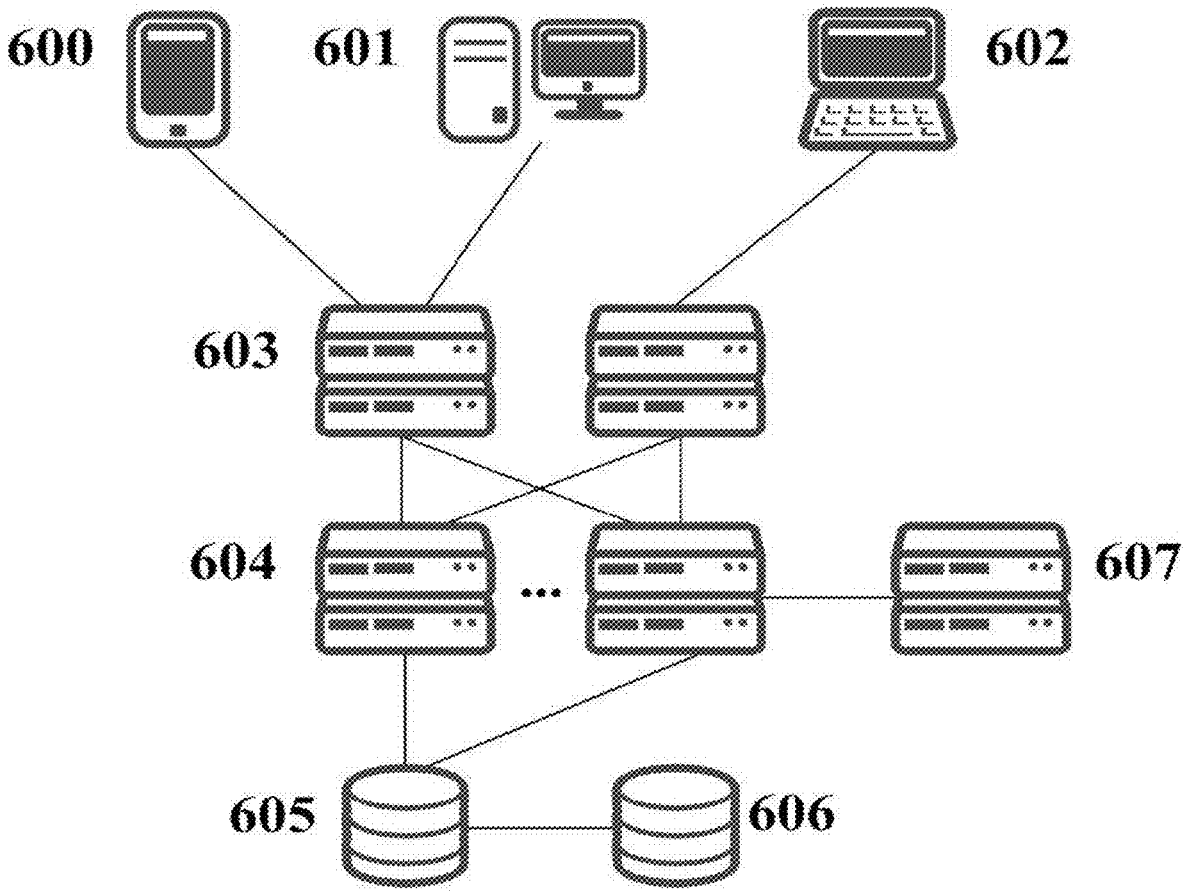
FIG. 6 depicts an exemplary network diagram for the server infrastructure for implementing embodiments of a group dynamic wagering system.

FIG. 6 depicts an exemplary network diagram for the server infrastructure for implementing embodiments of a group dynamic wagering system. In FIG. 6, game clients running on mobile devices 600, desktop computers 601, or laptop computers 602 may all connect to any one of two load balancers 603 using a round-robin DNS. When the game server domain name is resolved, e.g., game.lottopinion.com, the two IP addresses of load balancers 603 are returned in a random order, ensuring equal distribution of clients. Load balancers 603 will then distribute the requests to a game server 604, which is selected based on the current server load. At higher loads, new game servers may easily be added to the server pool by notifying the load balancers 603 of a new server. During the processing of the requests, game servers 604 will each access a common master database 605. Master database 605 will connect to a slave database 606 for backup and redundancy. Once a game server 604 has finished processing the request, the response is returned to the same load balancer 603 and back to the original game client 600-602. During scheduled times, game servers 604 will access social media servers 607 using their public APIs to retrieve and process recent posts.

Figure 7:
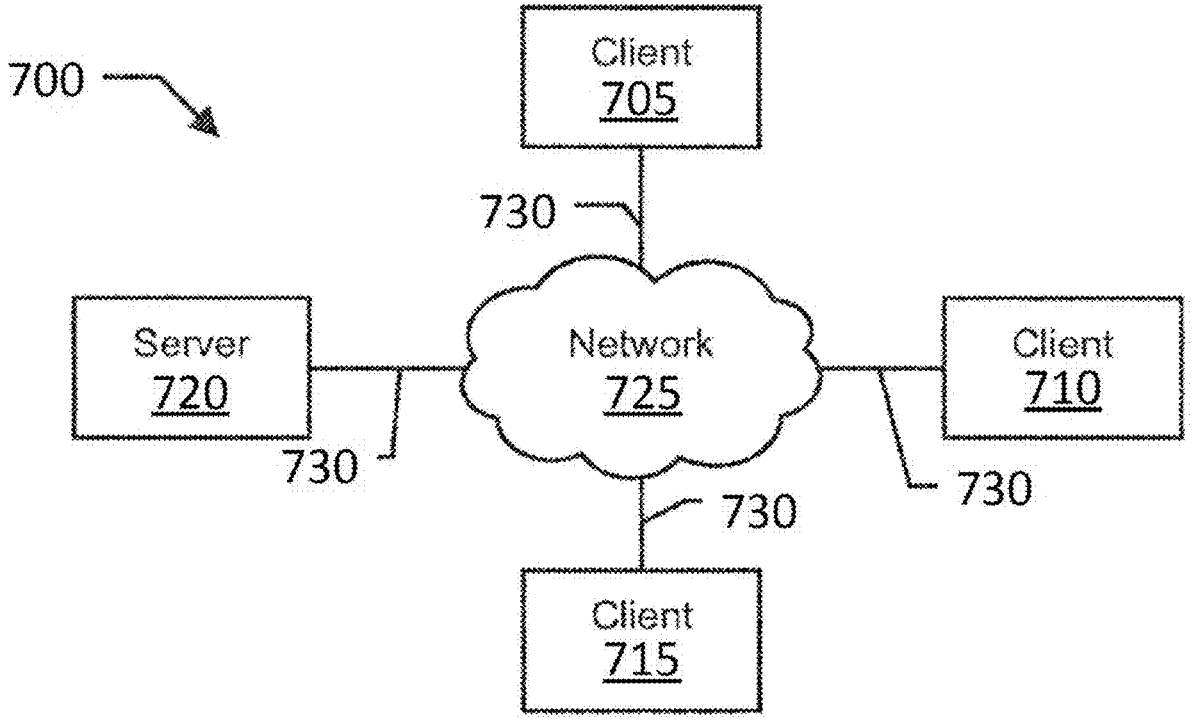
FIG. 7 depicts a simplified block diagram of an embodiment of a distributed computer system for implementing embodiments of a group dynamic wagering system.

FIG. 7 shows a simplified block diagram of an embodiment of a distributed computer system 700 for implementing embodiments of a group dynamic wagering system. Computer network 700 includes a number of client systems 705, 710, and 715, and a server system 720 coupled to a communication network 725 via a plurality of communication links 730. Communication network 725 provides a mechanism for allowing the various components of distributed network 700 to communicate and exchange information with each other The embodiments discussed with reference to FIGS. 1-6 may benefit from being implemented using a distributed computer system 700. Aspects of the server infrastructure described with reference to FIG. 6 may be combined with or substituted for aspects of computer network 700.

Communication network 725 may itself be comprised of many interconnected computer systems and communication links. Communication links 730 may be hardwire links, optical links, satellite or other wireless communications links, wave propagation links, or any other mechanisms for communication of information. Various communication protocols may be used to facilitate communication between the various systems shown in FIG. 7. These communication protocols may include TCP/IP, HTTP protocols, wireless application protocol (WAP), vendor-specific protocols, customized protocols, and others. While in one embodiment, communication network 725 is the Internet, in other embodiments, communication network 725 may be any suitable communication network including a local area network (LAN), a wide area network (WAN), a wireless network, an intranet, a private network, a public network, a switched network, Internet telephony, IP telephony, digital voice, voice over broadband (VoBB), broadband telephony, Voice over IP (VoIP), public switched telephone network (PSTN), and combinations of these, and the like.

System 700 in FIG. 7 is merely illustrative of an embodiment and does not limit the scope of the systems and methods as recited in the claims. One of ordinary skill in the art would recognize other variations, modifications, and alternatives. For example, more than one server system 720 may be connected to communication network 725. As another example, a number of client systems 705, 710, and 715 may be coupled to communication network 725 via an access provider (not shown) or via some other server system. An instance of a server system 720 and a computing device 705 may be part of the same or a different hardware system. An instance of a server system 720 may be operated by a provider different from an organization operating an embodiment of a system for wagering, or may be operated by the same organization operating an embodiment of a system for wagering.

Client systems 705, 710, and 715 typically request information from a server system which provides the information. Server systems by definition typically have more computing and storage capacity than client systems. However, a particular computer system may act as both a client and a server depending on whether the computer system is requesting or providing information. Aspects of the system may be embodied using a client-server environment or a cloud-cloud computing environment.

Server 720 is responsible for receiving information requests from client systems 705, 710, and 715, performing processing required to satisfy the requests, and for forwarding the results corresponding to the requests back to the requesting client system. The processing required to satisfy the request may be performed by server system 720 or may alternatively be delegated to other servers connected to communication network 725.

Client systems 705, 710, and 715 enable users to access and query information or applications stored by server system 720. Some example client systems include portable electronic devices (e.g., mobile communication devices) such as the Apple iPhone®, the Apple iPad®, the Palm Pre™, or any device running the Apple iOS™, Android™ OS, Google Chrome OS, Symbian OS®, Windows Mobile® OS, Palm OS® or Palm Web OS™ In a specific embodiment, a "web browser" application executing on a client system enables users to select, access, retrieve, or query information and/or applications stored by server system 720. Examples of web browsers include the Android browser provided by Google, the Safari® browser provided by Apple, the Opera Web browser provided by Opera Software, the BlackBerry® browser provided by Research In Motion, the Internet Explorer® and Internet Explorer Mobile browsers provided by Microsoft Corporation, the Firefox® and Firefox for Mobile browsers provided by Mozilla®, and others.

Figure 8:
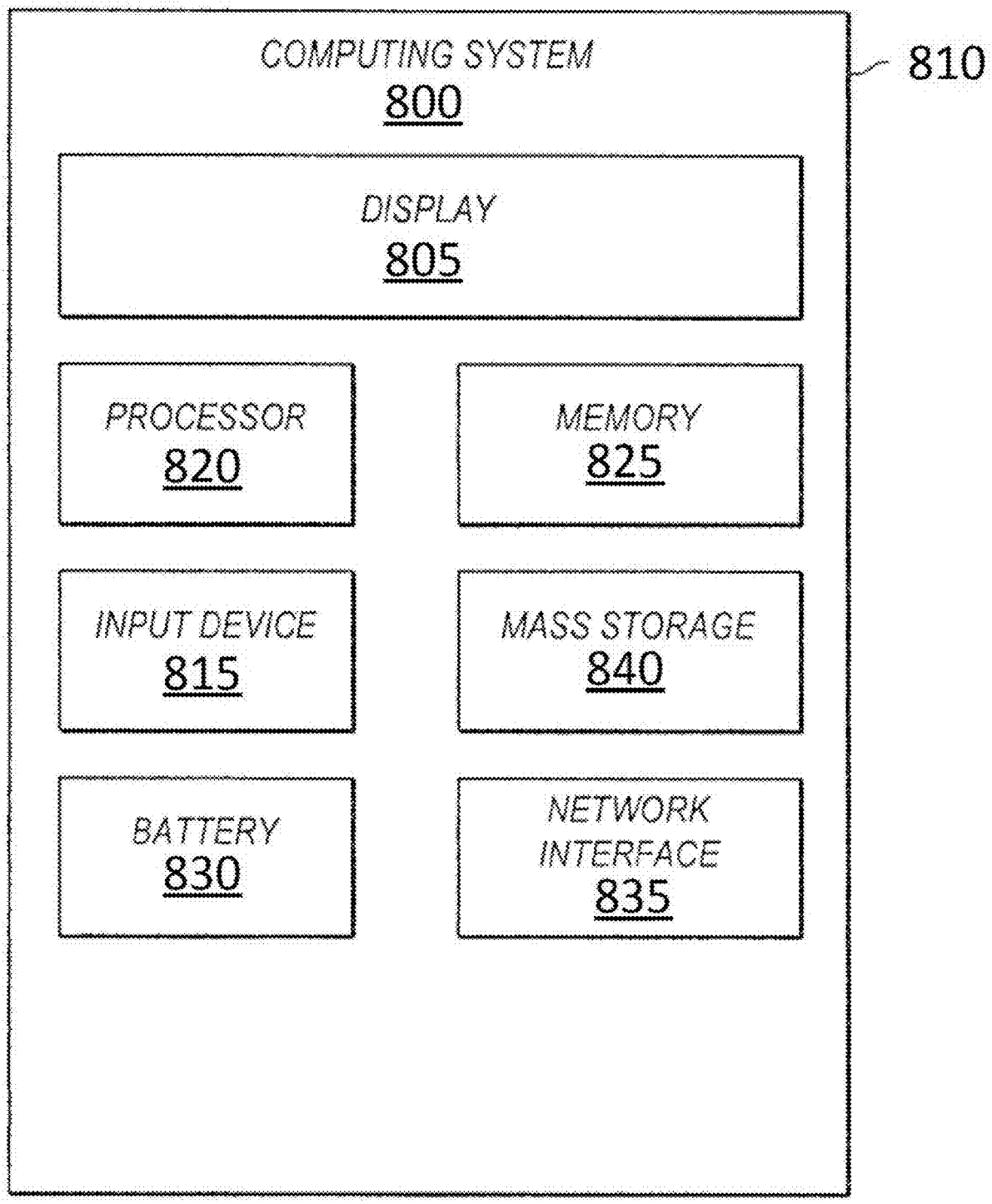
FIG. 8 depicts a more detailed diagram of an example of a computing device from a system for implementing embodiments of a group dynamic wagering system.

FIG. 8 shows a more detailed diagram of an example of a computing device from a system for implementing embodiments of a group dynamic wagering system. In an embodiment, a user interfaces with the system through a client system, such as shown in FIG. 8. Mobile client communication device or portable electronic device 800 includes a display, screen, or monitor 805, housing 810, and input device 815. Housing 810 houses familiar computer components, some of which are not shown, such as a processor 820, memory 825, battery 830, speaker, transceiver, network interface 835, microphone, ports, jacks, connectors, camera, input/output (I/O) controller, display adapter, network interface, mass storage devices 840, and the like. Computer system 800 may include a bus or other communication mechanism for communicating information between components. Mass storage device (or devices) 840 may store a user application and system software components. Memory 825 may store information and instructions to be executed by processor 820.

Input device 815 may also include a touchscreen (e.g., resistive, surface acoustic wave, capacitive sensing, infrared, optical imaging, dispersive signal, or acoustic pulse recognition), keyboard (e.g., electronic keyboard or physical keyboard), buttons, switches, stylus, gestural interface (contact or non-contact gestures), biometric input sensors, or combinations of these.

Mass storage device 840 may include flash and other nonvolatile solid-state storage or solid-state drive (SSD), such as a flash drive, flash memory, or USB flash drive. Other examples of mass storage include mass disk drives, floppy disks, magnetic disks, optical disks, magneto-optical disks, fixed disks, hard disks, CD-ROMs, recordable CDs, DVDs, recordable DVDs (e.g., DVD-R, DVD+R, DVD-RW, DVD+RW, HD-DVD, or Blu-ray Disc), battery-backed-up volatile memory, tape storage, reader, and other similar media, and combinations of these.

System 700 may also be used with computer systems having different configurations, e.g., with additional or fewer subsystems. For example, a computer system could include more than one processor (i.e., a multiprocessor system, which may permit parallel processing of information) or a system may include a cache memory. The computer system shown in FIG. 8 is but an example of a computer system suitable for use. Other configurations of subsystems suitable for use will be readily apparent to one of ordinary skill in the art. For example, in a specific implementation, the computing device is mobile communication device such as a smartphone or tablet computer. Some specific examples of smartphones include the Droid Incredible and Google Nexus One@, provided by HTC Corporation, the iPhone@ or iPad®, both provided by Apple, BlackBerry ZIO provided by BlackBerry (formerly Research In Motion), and many others. The computing device may be a laptop or a netbook. In another specific implementation, the computing device is a non-portable computing device such as a desktop computer or workstation.

A computer-implemented or computer-executable version of the program instructions useful to practice the present subject matter may be embodied using, stored on, or associated with computer-readable medium. A computer-readable medium may include any medium that participates in providing instructions to one or more processors for execution. Such a medium may take many forms including, but not limited to, nonvolatile, volatile, and transmission media. Nonvolatile media includes, for example, flash memory, or optical or magnetic disks. Volatile media includes static or dynamic memory, such as cache memory or RAM. Transmission media includes coaxial cables, copper wire, fiber optic lines, and wires arranged in a bus. Transmission media can also take the form of electromagnetic, radio frequency, acoustic, or light waves, such as those generated during radio wave and infrared data communications.

For example, a binary, machine-executable version, of the software useful to practice the present subject matter may be stored or reside in RAM or cache memory, or on mass storage device 840. The source code of this software may also be stored or reside on mass storage device 840 (e.g., flash drive, hard disk, magnetic disk, tape, or CD-ROM). As a further example, code useful for practicing the subject matter may be transmitted via wires, radio waves, or through a network such as the Internet. In another specific embodiment, a computer program product including a variety of software program code to implement features of the subject matter is provided.

Computer software products may be written in any of various suitable programming languages, such as C, C++, C#, Pascal, Fortran, Perl, Matlab (from MathWorks, www.mathworks.com), SAS, SPSS, JavaScript, CoffeeScript, Objective-C, Objective-J, Ruby, Python, Erlang, Lisp, Scala, Clojure, and Java. The computer software product may be an independent application with data input and data display modules. Alternatively, the computer software products may be classes that may be instantiated as distributed objects. The computer software products may also be component software such as Java Beans (from Oracle) or Enterprise Java Beans (EJB from Oracle).

An operating system for the system may be the Android operating system, iPhone OS (i.e., iOS), Symbian, BlackBerry OS, Palm web OS, bada, MeeGo, Maemo, Limo, or Brew OS. Other examples of operating systems include one of the Microsoft 'Windows family of operating systems (e.g., Windows 95, 98, Me, 'Windows NT, Windows 2000, Windows XP, Windows XP x64 Edition, Windows Vista, Windows 7, Windows CE, Windows Mobile, Windows Phone 7), Linux, HP-UX, UNIX, Sun OS, Solaris, Mac OS X, Alpha OS, AIX, IRIX32, or IRIX64. Other operating systems may be used.

Furthermore, the computer may be connected to a network and may interface to other computers using this network. The network may be an intranet, internet, or the Internet, among others. The network may be a wired network (e.g., using copper), telephone network, packet network, an optical network (e.g., using optical fiber), or a wireless network, or any combination of these. For example, data and other information may be passed between the computer and components (or steps) of a system useful in practicing the subject matter using a wireless network employing a protocol such as Wi-Fi (IEEE standards 802.11, 802.11a, 802.11b, 802.11e, 802.11g, 802.11i, and 802.11n, just to name a few examples). For example, signals from a computer may be transferred, at least in part, wirelessly to components or other computers.

Figure 9:
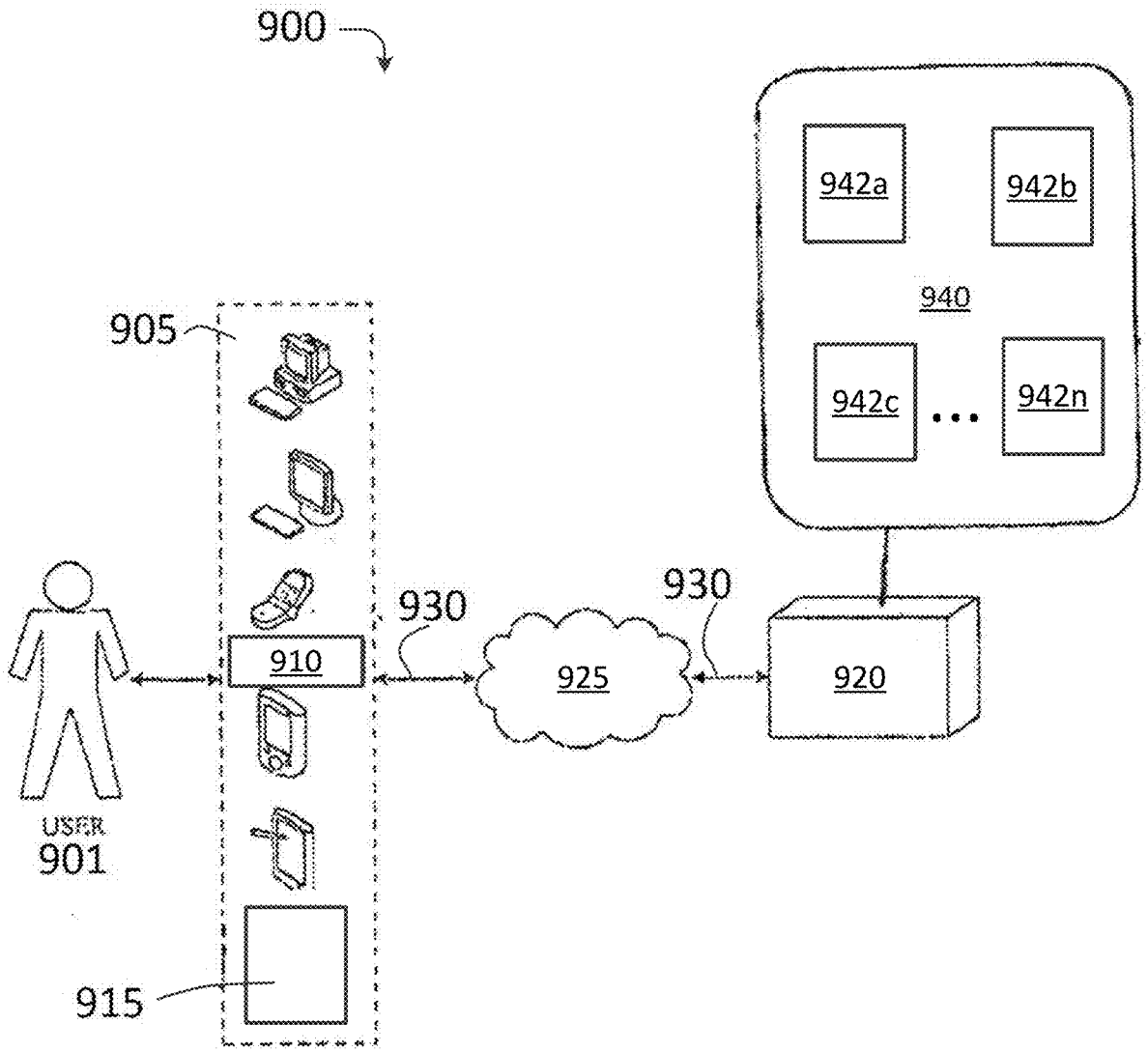
FIG. 9 depicts a simplified block diagram of an embodiment of a system for implementing embodiments of a group dynamic wagering system.

FIG. 9 is a simplified block diagram of an embodiment of a system 900 for implementing embodiments of a group dynamic wagering system. System 900 includes one or more user computing devices 905 (e.g., mobile device 600, desktop computer 601, laptop computer 602, computing system 800, and clients 705, 710, 715), and a server 920, coupled to a communication network 925 via a plurality of communication links 930. Computing device 905 may be used to run a user application 910 for deferring the sale of a service provider. User application 910 may use computing device 905 and network 925 to access server 920. Communication network 925 (or "network 925") provides a mechanism for allowing the various components of system 900 to communicate and exchange information with each other via communication links 930. Server 920 may run a wagering system component 940 (e.g., a component for providing a wagering service to a customer), which itself may be comprised of sub-components (e.g., 942*a*, 942*b*, 942*c*, . . . , 942*n*). Such sub-components may include one or more databases. Computing device 905 may itself run a wagering system component 915, which may perform as a wagering system component 940, or as one of sub-components 942*a*, 942*b*, 942*c*, . . . , 942*n* in communication with server 920 through network 925. Aspects of the server infrastructure described with reference to FIG. 6 may be combined with or substituted for aspects of computer network 900.

Network 925 may be any suitable communications network. Communication network 925 may itself be comprised of many interconnected computer systems and communication links. As an example, and not by way of limitation, one or more portions of network 925 may include an ad hoc network, an intranet, an extranet, a virtual private network (VPN), a local area network (LAN), a wireless LAN (WLAN), a wide area network (WAN), a wireless WAN (WWAN), a metropolitan area network (MAN), a portion of the Internet, a portion of the Public Switched Telephone Network (PSTN), a cellular telephone network, another suitable network, or a combination of two or more of these. Network 925 may include one or more networks 925.

Connections 930 may connect computing device 905 and server 920 to communication network 925 or to each other. Communication links 930 may be hardwire links, optical links, satellite or other wireless communications links, wave propagation links, or any other mechanisms for communication of information. This disclosure contemplates any suitable connections 925. In particular embodiments, one or more connections 925 include one or more wireline (such as for example Digital Subscriber Line (DSL) or Data Over Cable Service Interface Specification (DOCSIS)), wireless (such as for example Wi-Pi or Worldwide Interoperability for Microwave Access (WiMAX)) or optical (such as for example Synchronous Optical Network (SO NET) or Synchronous Digital Hierarchy (SDH)) connections. In particular embodiments, one or more connections 930 each include an ad hoc network, an intranet, an extranet, a VPN, a LAN, a WLAN, a WAN, a WWAN, a MAN, a portion of the Internet, a portion of the PSTN, a cellular telephone network, another suitable connection 930, or a combination of two or more such connections 930. Connections 930 need not necessarily be the same throughout system 900. One or more first connections 930 may differ in one or more respects from one or more second connections 930.

Server 920 may be a network-addressable computing system that can host one or more wagering system components 940. Server 920 may be responsible for receiving information requests from computing device 905 via user application 9 j 0, for performing the processing required to satisfy the requests, for generating responses to received inquiries, and for forwarding the results corresponding to the requests back to requesting computing device 905. Server 920 may store, receive, or transmit data and software, and information associated with the data and software (including user data). The processing required to satisfy the requests may be performed by server 920 or may alternatively be delegated to other servers connected to communication network 925. For example, other servers may host wagering system component 940, or have additional wagering system components. Server 920 may be an intermediary in communications between a computing device 905 and another server system, or a computing device 905 may communicate directly with another server system. Server 920 may be accessed by the other components of system 900, for example, directly or via network 925, In particular embodiments, one or more users 901 may use one or more computer devices 905 to access, send data to, and receive data from server 920.

Computing device 905, connections 930, and network 925, enable user 901 to access and query information stored and applications run by server 920, such as wagering system component 940. Some example computer devices 905 include desktop computers, portable electronic devices (e.g., mobile communication devices, smartphones, tablet computers, laptops) such as the Samsung Galaxy Tab®, Google Nexus devices, Amazon Kindle@, Kindle Fire@, Apple iPhone@, the Apple iPad®, Microsoft Surface®, the Palm Pre™, or any device running the Apple iOS@, Android® as, Google Chrome® OS, Symbian OS®, Windows Mobile® OS, Windows Phone, BlackBerry® as, Embedded Linux, Tizen, Sailfish, webOS, Palm OS (ID or Palm Web OS®.

In an embodiment, user application 910 may be run or executed by a different system. For example, computing device 905, or server 920, or both, may run user application 910. That is, user application 910 may be run by computing device 905, or the application may be run on server 920 and accessed by computing device 905 through a browser and network 925. For example, computing device 905 could be operated as a terminal, with user application 910 being run on a server, e.g., server 920, In an embodiment, aspects or functionalities of user application 910 are run by server 920, or another computing system or server. In an embodiment, the steps of the methods described herein may be performed, at least in part, in cloud-computing environment.

FIG. 9 illustrates a particular arrangement of user 901, computing device 905, and server 920, but this is an example arrangement. Any other suitable arrangement of user 901, computing device 9~5, server 920, and network 925 may be used. For example, computing device 905 may be connected directly to server 920. Also, computing device 905 and server 920 may appear to be distinct yet operate on the same hardware. In addition, any number of users 901, clients 905, and server 920 may be used in embodiments.

In an embodiment, a method for wagering comprises, in a first step, receiving, by a software component executing on a server, a selection from among a set of choices by each of a plurality of users, each selection being associated with the selecting user and stored by the software component. In a second step, the software component determines a first group dynamic by: retrieving the selections and the associated users at a first time, and determining a first ranking of the set of choices based on the number of each choice in the selections retrieved at the first time, with the ranking providing a most-selected choice. In a third step, the software component determines a degree to which a first user of the plurality of users matches the first group dynamic by determining where the selection associated with the first user, and retrieved at the first time, placed in the first ranking of the set of choices. And in a fourth step, the software component determines that the first user is due a first award based on the determined degree to which the first user matches the first group dynamic. An embodiment may further include the software component providing a question to the plurality of users, where one of the set of choices is a correct answer to the question. An embodiment may further include the software component determining that the first user is due a bonus award when: the selection associated with the first user matches the most-selected choice, and the most-selected choice matches the correct answer. An embodiment may further include the software component providing a question to the plurality of users, where each choice includes one of an opinion and a preference. In an embodiment, the software component's receiving of a selection from among a set of choices by each of a plurality of users may be an on-going process such that additional users may be added to the plurality of users with time, and the method may further include: 1) the software component determining a second group dynamic by: retrieving the selections and associated users at a second time, and determining a second ranking of the set of choices based on the number of each choice in the selections retrieved at the second time; 2) the software component determining a degree to which a second user of the plurality of users matches the second group dynamic by determining where the selection associated with the second user, and retrieved at the second time, placed in the second ranking of the set of choices; and 3) the software component determining that the second user is due a second award based on the determined degree to which the second user matches the second group dynamic. In an embodiment, the second user and the first user may be the same user.

In an embodiment, a method for wagering comprises, in a first step, a software component executing on a server receiving a first selection from among a set of choices by each of a plurality of users, each first selection being associated with the selecting user and stored by the software component, the set of choices including a correct choice. In a second step the software component determines a first group dynamic by: retrieving the first selections and the associated users at a first time, determining a first most-selected choice from the set of choices based on the number of each choice in the first selections retrieved at the first time, and comparing the first most-selected choice to the correct choice to determine whether the first most-selected choice is the same as the correct choice. In a third step the software component determines a degree to which a first user of the plurality of users matches the first group dynamic by: receiving from the first user a second selection of whether the first most-selected choice is the same as the correct choice, and comparing the second selection to the determination of whether the first most-selected choice is the same as the correct choice. And, in a fourth step, when the comparison determines that the second selection matches the determination of whether the first most-selected choice is the same as the correct choice, the software component determines that the first user is due a first award. In an embodiment, the correct choice may correspond to a question provided by the software component to the plurality of users. An embodiment may further include the software component determining that the first user is due a bonus award when: the second selection matches the determination of whether the first most-selected choice is the same as the correct choice, and the most-selected choice matches the correct answer. In an embodiment, the software component's receiving a first selection from among a set of choices by each of a plurality of users may be an on-going process such that additional users may be added to the plurality of users with time, and the method may further include: 1) determining, by the software component, a second group dynamic by: retrieving the first selections and the associated users at a second time, determining a second most-selected choice from the set of choices based on the number of each choice in the first selections retrieved at the second time, and comparing the second most-selected choice to the correct choice to determine whether the second most-selected choice is the same as the correct choice; 2) determining, by the software component, a degree to which a second user of the plurality of users matches the second group dynamic by: receiving from the second user a third selection of whether the second most-selected choice is the same as the correct choice, and comparing the third selection to the determination of whether the second most-selected choice is the same as the correct choice; and 3) when the comparison determines that the third selection matches the determination of whether the second most-selected choice is the same as the correct choice, determining, by the software component, that the second user is due a second award. In an embodiment, the second user and the first user may be the same user.

In an embodiment a method for wagering comprises, in a first step, a software component executing on a server receiving a first selection from among a set of choices by a first user, the first selection being associated with the first user and stored by the software component, the set of choices including a correct choice. In a second step the software component determines a target response by comparing the first selection to the correct choice to determine whether the first selection is the same as the correct choice. In a third step the software component determines a degree to which a second user matches the target response by: receiving a second selection by the second user of whether the first selection is the same as the correct choice, and comparing the second selection to the target response. And in a fourth step, when the second selection is determined to match the target response, the software component determines that the second user is due a first award. In an embodiment, the correct choice may corresponds to a question provided by the software component to the first and second users. An embodiment may further include the software component determining that the second user is due a bonus award when: the first selection associated with the first user matches the correct choice, and the second selection is determined to match the target response.

In an embodiment a method for wagering comprises, in a first step, a software component executing on a server receiving a first set of selections from among a set of choices by each of a plurality of users, each first set of selections being associated with the selecting user and stored by the software component. In a second step the software component determines a first group dynamic by: retrieving the first sets of selections and the associated users at a first time, and determining a first plurality of most-selected choices from the set of choices based on the number of each choice in the first sets of selections retrieved at the first time. In a third step the software component determines a degree to which a first user of the plurality of users matches the first group dynamic by: receiving from the first user a first estimation of the number of selections from the first user's first set of selections retrieved at the first time that are also contained in the determined first plurality of most-selected choices, comparing the first user's first set of selections retrieved at the first time to the determined first plurality of most-selected choices to determine a first number of matches, and comparing the first number of matches to the first estimation. And, in a fourth step, when the determined first number of matches is equal to or greater than the first estimation, the software component determines that the first user is due a first award. An embodiment may further include the software component providing a question to the plurality of users, where each of the set of choices is a potential answer to the question. An embodiment may further include the software component providing a plurality of questions to the plurality of users, where the set of choices includes a plurality of potential answers to each question of the plurality of questions. In an embodiment the software component's receiving a first set of selections from among a set of choices by each of a plurality of users may be an on-going process such that additional users may be added to the plurality of users, and the method may further include: 1) the software component determining, by the software component, a second group dynamic by: retrieving the first sets of selections and the associated users at a second time, and determining a second plurality of most-selected choices from the set of choices based on the number of each choice in the first sets of selections retrieved at the second time; 2) the software component determining a degree to which a second user of the plurality of users matches the second group dynamic by receiving from the second user a second estimation of the number of selections from the second user's first set of selections retrieved at the second time that are also contained in the determined second plurality of most-selected choices, comparing the second user's first set of selections retrieved at the second time to the determined second plurality of most-selected choices to determine a second number of matches, and comparing the second number of matches to the second estimation; and 3) when the determined second number of matches is equal to or greater than the second estimation, the software component determining that the second user is due a second award. In an embodiment, the second user and the first user may be the same user.

In an embodiment, group dynamics are used to determine the outcome of a wager based on the popularity of a personal preference. The results of the wager may be based entirely on the relative popularity of the choice compared to the group as a whole. The result of the wager may change dynamically based on real-time answers of others in the group.

In an embodiment, group dynamics are used to determine the outcome of a wager based on an answer to a trivia question and the believed most popular answer to that question. The base winnings may be determined by a correct answer, and bonus winnings may be added if the most popular answer was chosen correctly and timely. The base result of the wager may dynamically based on real-time answers of others in the group.

In an embodiment, group dynamics are used to determine the outcome of a wager based on an answer to a trivia question and the believed answer of a player's opponent. The base winnings may be determined by a correct answer and bonus winnings may be added if the opponent's answer was chosen correctly and timely.

In an embodiment, group dynamics are used to determine the outcome of a wager based on the popularity of a chosen number of personal preferences out of a larger pool. The base winnings may be determined by the popularity of the personal choices compared to the group, as well as by a player correctly guessing the number of their opinions that were popular.

In the description above and throughout, numerous specific details are set forth in order to provide a thorough understanding of an embodiment of this disclosure. It will be evident, however, to one of ordinary skill in the art, that an embodiment may be practiced without these specific details. In other instances, well-known structures and devices are shown in block diagram form to facilitate explanation. The description of the preferred embodiments is not intended to limit the scope of the claims appended hereto. Further, in the methods disclosed herein, various steps are disclosed illustrating some of the functions of an embodiment. These steps are merely examples, and are not meant to be limiting in any way. Other steps and functions may be contemplated without departing from this disclosure or the scope of an embodiment.

What is claimed is:

1. A method for wagering comprising:

providing instructions, by a first software component, that cause the display of a graphical user interface and a set of choices on each of a first plurality of network-enabled computing devices, each computing device associated with a user from a first plurality of users;

providing to each of the first plurality of network-enabled computing devices, an internet protocol (IP) address of one of at least two load balancers in response to a request to resolve a domain name of the first server;

receiving, by each of the at least two load balancers, in response to a level of demand on the first server, a notification of a second server with a second software component executing on the second server;

distributing, by the at least two load balancers, requests from a second plurality of network-enabled computing devices to the second server;

providing instructions, by the first software component, that cause the display, to each user of the first plurality of users, of a request for selection from among the set of choices using the graphical user interface;

providing instructions, by the second software component, that cause the display, to each user of the second plurality of users, of the request for selection from among the set of choices using the graphical user interface;

receiving, by the first software component, a first set of selections from among the set of choices from each user of the first plurality of users, each first set of selections being stored by the first software component on a network-accessible database and associated with the user that provided the first set;

receiving, by the second software component, a first set of selections from among the set of choices from each of the second plurality of users associated with the second plurality of network-enabled computing devices, each first set of selections from the second plurality of users being stored by the second software component on the network-accessible database and associated with the user from the second plurality of users that provided the first set;

determining, by the first software component, a first group dynamic by:

retrieving the first sets of selections from both the first plurality of users and the second plurality of users at a second time, and determining a first plurality of most-selected choices from the set of choices based on the number of each choice in the first sets of selections retrieved at the second time;

determining, by the first software component, a degree to which a first user matches the first group dynamic by:

providing instructions that cause the graphical user interface to request from each user of the first plurality an estimation of the number of selections from the user's first set of selections that are also contained in the determined first plurality of most-selected choices;

receiving from each user a first estimation of the number of selections from the user's first set of selections that are also contained in the determined first plurality of most-selected choices, each first estimation entered using the graphical user interface, comparing each user's first set of selections to the determined first plurality of most-selected choices to determine a first number of matches for each user, and comparing each user's first number of matches to that user's first estimation; and when a first user's determined first number of matches is equal to or greater than the first user's first estimation:

determining, by the first software component, that the first user is due a first award;

updating, by the first software component, an account balance of the first user to include the first award; and providing instructions, by the first software component that cause the graphical user interface on the computing device associated with the first user, to display the first award and the updated account balance, wherein:

between the first time and the second time, the providing instructions that cause the display of a set of choices, the providing instructions that cause the request for selections from each user, the receiving a first set of selections, the providing instructions that cause the request for an estimation, and the receiving from each user a first estimation are each performed individually with respect to each user without regard to any other user.

2. The method of claim 1 further comprising providing, by the first software component, a question to the first plurality of users, wherein each of the set of choices is a potential answer to the question.

3. The method of claim 1 further comprising providing, by the first software component, a plurality of questions to the first plurality of users, wherein the set of choices includes a plurality of potential answers to each question of the plurality of questions.

4. The method of claim 1, wherein the receiving, by the first software component, a first set of selections from among the set of choices from each user of a first plurality of users, is an on-going process such that additional users may be added to the first plurality of users, the method further including:

determining, by the first software component, a second group dynamic by:

retrieving the first sets of selections from both the first plurality of users and the second plurality of users at a second time, and determining a second plurality of most-selected choices from the set of choices based on the number of each choice in the first sets of selections retrieved at the second time;

determining, by the first software component, a degree to which a second user of the first plurality of users matches the second group dynamic by:

receiving from the second user a second estimation of the number of selections from the second user's first set of selections retrieved at the second time that are also contained in the determined second plurality of most-selected choices, comparing the second user's first set of selections retrieved at the second time to the determined second plurality of most-selected choices to determine a second number of matches, and comparing the second number of matches to the second estimation; and when the determined second number of matches is equal to or greater than the second estimation, determining, by the first software component, that the second user is due a second award.

5. The method of claim 4, wherein the second user and the first user are the same user.

6. The method of claim 1 further comprising: providing, on the display, a first timer indicating an amount of time remaining for the first user to select from among the set of choices and a second timer indicating an amount of time remaining for the first user to make the first estimation.

7. The method of claim 1, wherein the receiving, by the first software component, the first set of selections from among the set of choices from each of the first plurality of users, includes the first software component receiving the first set of selections from the first user during a first period of time and receiving the first set of selections from a second user during a second period of time overlapping the first period of time.

8. The method of claim 1, wherein retrieving the first sets of selections from both the first plurality of users and the second plurality of users at a second time includes retrieving the first sets of selections from the network-accessible database upon the first user completing the first user's selection from among the set of choices.

9. The method of claim 1, wherein retrieving the first sets of selections from both the first plurality of users and the second plurality of users at a second time includes retrieving the first sets of selections from the network-accessible database a pre-determined time period after a step of the method.

* * * * *